United States Patent [19]

Tchernyak

[11] Patent Number: 4,549,935

[45] Date of Patent: Oct. 29, 1985

[54] CONDITIONING DRUM FOR A TAR SANDS HOT WATER EXTRACTION PROCESS

[75] Inventor: Shimon S. Tchernyak, Edmonton, Canada

[73] Assignee: Suncor, Inc., Toronto, Canada

[21] Appl. No.: 505,004

[22] Filed: Jun. 16, 1983

Related U.S. Application Data

[62] Division of Ser. No. 248,780, Mar. 30, 1981, abandoned.

[30] Foreign Application Priority Data

Apr. 8, 1980 [CA] Canada ..... 349292

[51] Int. Cl.[4] ..... C10C 3/08

[52] U.S. Cl. ..... 196/14.52; 196/126; 422/209; 422/271

[58] Field of Search ..... 248/780; 208/11 R, 11 LE; 422/200, 201, 203, 207, 209, 288, 289, 270, 271, 278, 284, 287, 309; 196/14.52, 126

[56] References Cited

U.S. PATENT DOCUMENTS 1,307,508 6/1919 Meakin et al. ..... 422/309
2,453,060 11/1948 Bauer et al. ..... 196/14.52
3,530,042 9/1970 Graybill et al. ..... 196/14.52
4,172,025 10/1979 Porteous et al. ..... 196/14.52

FOREIGN PATENT DOCUMENTS 918588 1/1973 Canada ..... 208/11 LE

*Primary Examiner*—Peter Kratz
*Attorney, Agent, or Firm*—Paul Lipsitz

[57] ABSTRACT

The thermodynamic efficiency of a tar sands conditioning drum is improved by continuously and simultaneously discharging steam from all the nozzles of an array of a few relatively large nozzles distributed circumferentially around the inner drum periphery rather than selectively sparging the steam only from those nozzles beneath the tar sands pulp surface. As a result, the drum shell and components above the pulp are heated and thus heat the pulp by radiation and, after entering the pulp, by convection as well as by sparging. Hot water droplets formed continuously in the steam cloud rain onto the pulp surface to provide another highly important heat transfer mechanism. Coincidentally, mechanical reliability and economics are achieved by eliminating the sparge valve and multiplicity of smaller nozzles which characterize the prior art tar sands conditioning drums.

1 Claim, 3 Drawing Figures

CONDITIONING DRUM FOR A TAR SANDS HOT WATER EXTRACTION PROCESS

This application is a division of application Ser. No. 248,780, filed Mar. 30, 1981 now abandoned.

BACKGROUND OF THE INVENTION

This invention relates to the hot water process for extracting bitumen from tar sands and, more particularly, to an improved conditioning or mulling drum in which the tar sands are submitted to a critical step in the process.

Tar sands (which are also known as oil sands and bituminous sands) are sand deposits which are impregnated with dense, viscous, petroleum. Tar sands are found throughout the world, often in the same geographical areas as conventional petroleum. The largest deposit, and the only one of present commercial importance, is in the Athabasca region in the northeast of the province of Alberta, Canada. This deposit is believed to contain perhaps 700 billion-one trillion barrels of bitumen. For comparison, 700 billion barrels is just about equal to the world-wide reserves of conventional oil, 60% of which is found in the Middle East. While much of the Athabasca deposit is not economically recoverable on a commercial scale with current technology, nonetheless, a substantial portion is situated at, or very near, the surface where it may fairly readily be mined and processed into synthetic crude oil, and this procedure is being carried out commercially on a very large scale by Great Canadian Oil Sands (now Suncor Inc.-Oil Sands Division) and Syncrude near Fort McMurray, Alberta.

Athabasca tar sands are a three-component mixture of bitumen, mineral and water. Bitumen is the valuable component for the extraction of which tar sands are mined and processed. The bitumen content is variable, averaging 12 wt% of the deposit, but ranging from 0 to 18 wt%. Water typically runs 3 to 6 wt% of the mixture, and generally increases as the bitumen content decreases. The mineral content is realtively constant, ranging from 84 to 84 wt%.

While several basic extraction methods to separate the bitumen from the sands have been known for many years, the "hot water" process is the only one of present commercial significance and is employed by both Suncor and Syncrude. The hot water process for achieving primary extraction of bitumen from tar sands consists of three major process steps (a fourth step, final extraction, is used to clean up the recovered bitumen from downstream processing). In the first step, called conditioning, tar sands are mixed with water and heated with open steam to form a pulp of 70 to 85 wt% solids. Sodium hydroxide or other reagents are added as required to maintain pH in the range of 8.0–8.5. In the second step, called separation, the conditioned pulp is diluted further so that settling can take place. The bulk of the sand-size mineral rapidly settles and is withdrawn as sand tailings. Most of the bitumen rapidliy floats (settles upwardly) to form a coherent mass known a froth which is recovered by skimming the settling vessel. A third stream, called the middlings drag stream, may be withdrawn from the settling vessel and subjected to a third processing step, scavaging, to provide incremental recovery of suspended bitumen.

Final extraction or froth clean-up is typically accomplished by centrifugation. Froth from primary extraction is diluted with naphtha, and the diluted froth is then subjected two a two-stage centrifugation. This process yields an essentially pure diluted bitumen oil product. Water and mineral removed from the froth during this step constitutes an additional tailings stream which must be disposed of.

As previously discussed, it is necessary to best operation of the hot water process that the tar sands be intimately contacted with steam and water in the initial mulling stage and that adequate agitation be applied to the mixture of tar sands and water to produce a pulp with a fairly uniform distribution of water. Proper contact of the tar sands with steam and water and proper mulling of the pulp is essential so that initial displacement of the sand particles from the bitumen can take place through the relative preferential affinity of the sand particles for water.

The physics of the separation of the bitumen requires that, in order to float, the bitumen be free from most of the mineral and contain enough gas to make the particles less dense than water. Also, the particles must be larger than about 30 microns in diameter in order to float in the time allowed. One observable effect of increased clay in the tar sands is to make the particles of oil smaller. When the sands are not conditioned properly, these flecks remain in the water-clay layer in the separation cell.

The previously preferred prior art conditioning drums are disclosed in Canadian Pat. No. 918,588, entitled "Hot Water Process Conditioning Drum", issued Jan. 9, 1973, to Marshall R. Smith, Frederick W. Camp, George H. Evans, and Jack E. Tinkler. Drums of the configuration disclosed therein have been employed for a number of years at the Suncor and Syncrude facilities. While this prior art conditioning drum has proved serviceable, experience at Suncor has revealed certain important drawbacks. It may be noted that this prior art conditioning drum emploiys a sparge valve as a distributing device which limits the discharge of the steam to those spider pipes instantaneously below the pulp level as the drum rotates. This concept was based on the theory that the heat transfer from the steam to the pulp is best achieved by injecting and condensing it directly therein. It has been found, however, that there are deficiencies in this original theory. The remaining spider pipes have been kept empty; therefore, the pipes and other components inside the drum and the drum shell itself have been exposed directly to ambient temperature. Thus, a majority of the spider pipes inside of the drum and the drum's shell and other internal components all remain cold and function as a cooling surface such that converse heat transfer takes place from the hot pulp to the drum structure. Because the majority of the drum structure remains much cooler than the pulp, heat transfer by radiation and convective heat exchange from the drum structure to the pulp is impossible. Further, the spider pipes (straight pipes with longitudinally arrayed rows of nozzles) distribute the steam along the drum in such a way that the majority of the steam under higher temperature is injected near the discharge end of the drum where the temperature of the pulp is the highest. Therefore, the conditions of steam condensation are poorest, and residence time of the pulp under high temperature inside of the drum is short.

Additionally, as a practical matter, there are very definite deficiencies in the prior art conditioning drum from the maintenance point of view. As previously noted, the steam is only sparged below the pulp surface which requires the use of a very large sparge valve as a mechanical distributing device. The sparge valve is a complicated and uncontrolled mechanical device inside of the drum. It is subjected to very rough service (sand, dirt, and even small rocks, pass through the sparge valve hub), and, as a result, lifetime of the sparge valve is unacceptably short and cannot be improved. In a related aspect, the prior art conditioning drums have only about 25% of the some 1200 nozzles under the pulp surface at a given time, but all of the nozzles have to be maintained in good condition and replaced by new nozzles continuously. It wil be apparent that a large stock of spare parts (bearings, seals, sparge valves, subassemblies, nozzles, etc.) must be maintained. Considering labor and time required for a regular sparge valve and nozzle change-out, this operation is manifestly very costly and causes production losses during the necessarily long drum shutdown.

From the foregong, it will be readily apparent to those skilled in the art that it would be highly desirable to provide a conditioning drum which is thermodynamically superior and simpler and less costly to fabricate and maintain than the prior art conditioning drum.

OBJECTS OF THE INVENTION

It is therefore a broad object of this invention to provide an improved conditioning drum for mulling tar sands.

It is another object of this invention to provide a conditioning drum for mulling tar sands which is thermodynamically superior to the prior art conditioning drum.

In another aspect, it is an object of this invention to provide a conditioning drum for mulling tar sands which is more reliable and easier to maintain than the prior art conditioning drums.

It is a more specific object of this invention to provide a conditioning drum for mulling tar sands which employs a single, relatively large steam injection nozzle proximate each end of each spider pipe arm and in which all such nozzles are simultaneously and continuously supplied with steam.

BRIEF SUMMARY OF THE INVENTION

Briefly, these and other objects of the invention are achieved by providing a steam distribution network within the conditioning drum which consists of a plurality (typically twelve) of horizontal distribution pipes arrayed around the inner periphery of the drum. A single large nozzle is positioned near the outboard end of each distribution pipe and is directed radially inwardly. The distribution pipes are supplied with steam through a centrally positioned radial distribution unit comprising a stationary member, a rotating member and appropriate seal. As a result, the sparge valve employed in the prior art conditioning drum is eliminated with a consequent highly significant increase in reliability and lower maintenance cost. The thermodynamic efficiency of the system is greatly improved because heating of the tar sands mixture takes place not only due to sparging, but also due to heat transfer by radiation and convective heat exchange from the drum structure to the pulp.

DESCRIPTION OF THE DRAWING

The subject matter of the invention is particularly pointed out and distinctly claimed in the concluding portion of the specification. The invention, however, both as to organization and method of operation, may best be understood by reference to the following detailed description taken with reference to the accompanying drawing of which:

DETAILED DESCRIPTION OF THE INVENTION

Figure 1:
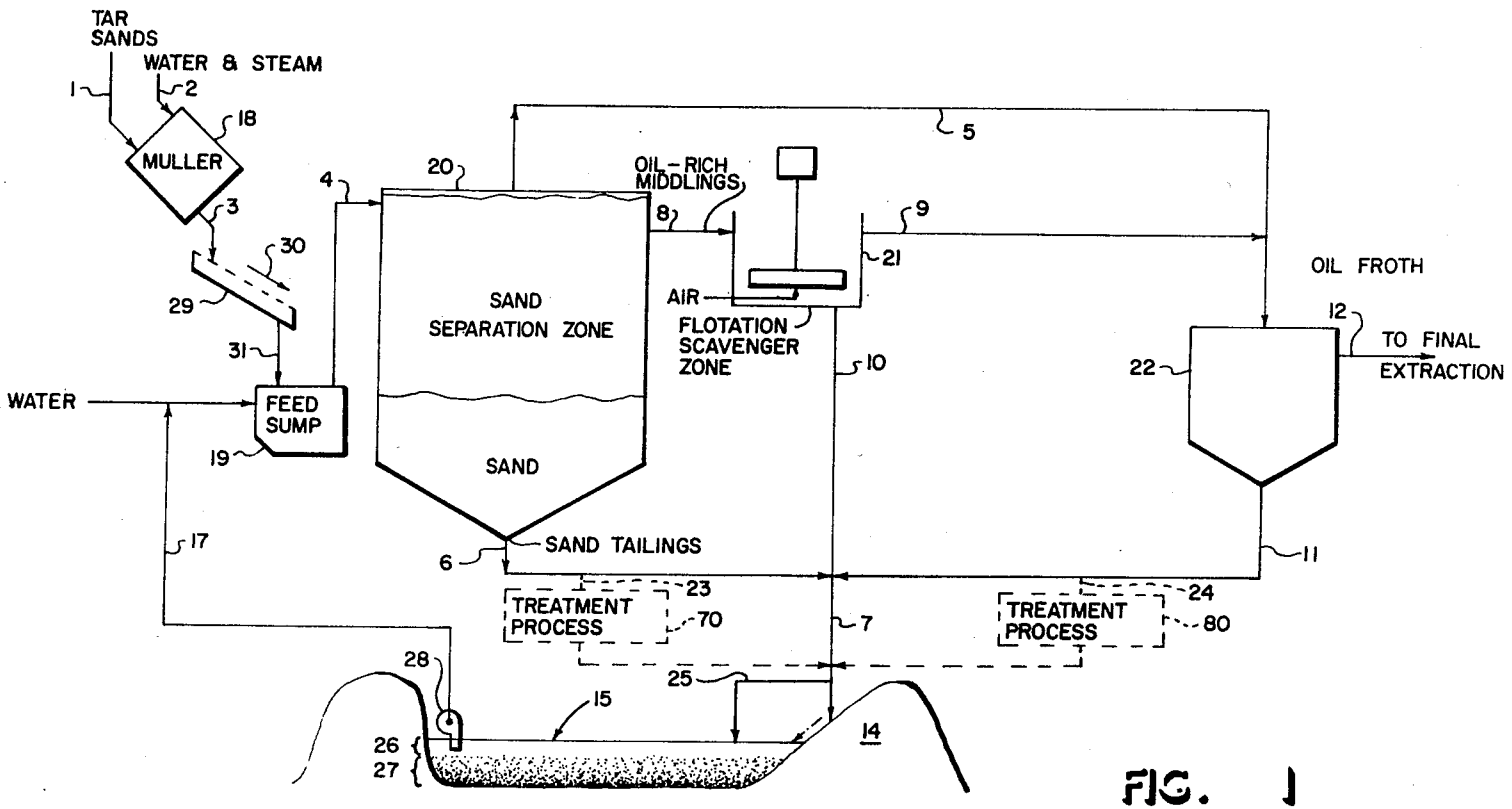
FIG. 1 is a somewhat simplified schematic representation of a hot water process for extracting bitumen from tar sands.

Referring now to FIG. 1, bituminous tar sands are fed into the system through a line 1 and passed to a conditioning drum or muller 18. Water and steam are introduced into the drum through another line 2. The total water so introduced in liquid and vapor form is a minor amount based on the weight of the tar sands processed. The tar sands, heated and conditioned with steam and water, pass through a line 3 to a screen 29. The purpose of the screen 29 is to remove from the pulp any debris such as rock or oversized lumps of clay as indicated generally at 30. The oversize material is discarded at a suitable site. The conditioned pulp passes through a line 31 to a feed sump 19 which serves as a zone for diluting the pulp with additional water before it enters a separation zone 20.

The diluted pulp is continuously flushed from the feed sump 19 through a line 4 into the separation zone 20. The settling zone within the separator 20 is relatively quiescent so that bituminous froth rises to the top and is withdrawn through a line 5 while the bulk of the sand component settles to the bottom as a tailings layer which is withdrawn through line 6. It will be understood, of course, that the tailings streams can be transferred individually, with or without downstream treatment, as indicated by the alternate lines 23, 24 and optional treatment processes 70, 80.

A relatively bitumen-rich middlings stream is withdrawn through line 8 to maintain the middlings layer between the froth and the sand layer at a functional viscosity. This middlings material is transferred to a flotation scavenger zone 21 where an air flotation operation is conducted to bring about the formation of additional bituminous froth which passes from the scavenger zone 21 through line 9, in conjunction with the primary froth from the separation zone 20 passing through line 5, to a froth settler zone 22. A bitumen-lean water stream is removed from the bottom of the scavenger zone 21 through line 10. In the froth settler zone 22, some further bitumen-lean water is withdrawn from the froth and removed through line 11 to be mixed with the bitumen-lean water stream from the flotation scavenger zone and the sand tailings stream from the separation zone 20. The bitumen from the settler 22 is removed through line 12 for further treatment, typically final extraction.

Bitumen-lean water from the froth settler 22, the scavenger zone 21, and the separation zone 20, all of which make up an effluent discharge stream carried by line 7, are discharged into a tailings pond 15 which has a clarified water layer 26 and a sludge layer 27. The sand included in the tailings stream quickly settles in the region 14, and the fines-containing water flows into the body of the pond 15 where settling takes place. Water from the clarified water layer 26 may be withdrawn by a pump 28 for recycle through a line 17 to be mixed with fresh makeup water and charged into the hot water process.

Figure 2:
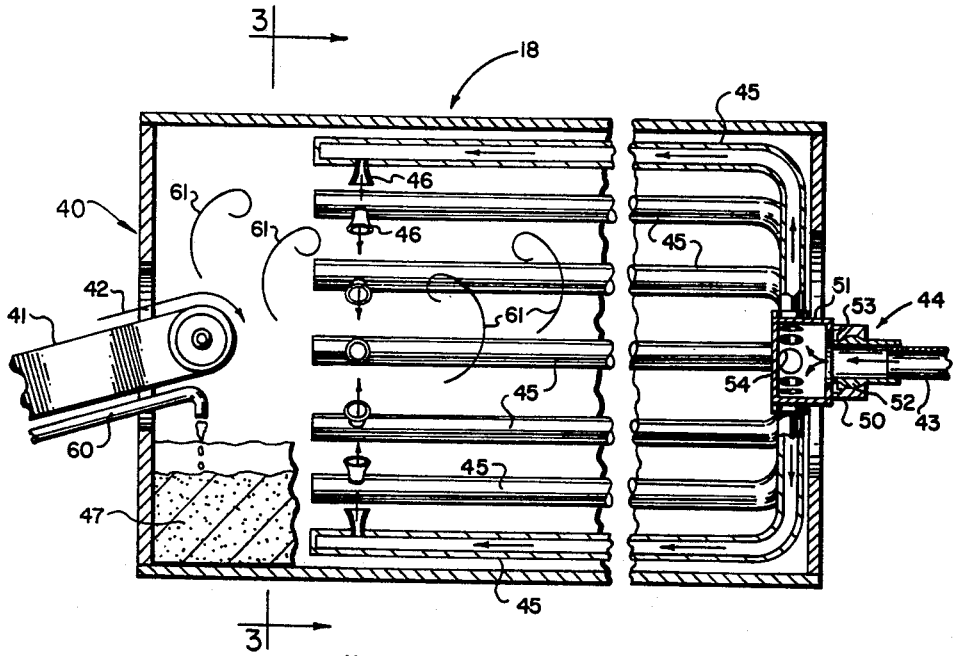
FIG. 2 is a simplified cross-sectional view taken through the axis of a conditioning drum constructed in accordance with the present invention.

Consider now FIG. 2 which is a cross-sectional view taken through the axis of the conditioning drum 18 of FIG. 1 in a presently preferred embodiment according to the invention. Tar sands are introdued into the outboard end 40 of the drum 18 by a conveyor belt 41 as indicated by the arrow 42. Hot water from any suitable source is added through a pipe 60. Simultaneously, steam is introduced into the interior of the drum from a source (not shown) through a conduit 43 which terminates into a steam distribution fitting 44. The steam distribution fitting 44 includes a stationary portion 50 which is coupled to the steam supply conduit 43 and a rotatable portion 51 which is rotatably supported on the stationary portion 50 by journal bearings 52. A circumferential seal 53 is disposed between the stationary and rotatable fitting portions to contain the steam within the fitting 44. The rotatable portion 51 is generally hollow and has outlet ports 54 which are radially outwardly directed to connect with an array of spider pipes 45. Thus, the fitting 44 distributes the steam flow into the spider pipes 45 which are equally circumferentially distributed around the interior of the drum 18 and disposed generally parallel to the drum axis. The spider pipes 45 are closed off at their outboard terminals, and single radially inwardly directed nozzles 46 are disposed proximate the outboard terminal of each spider pipe.

It may be noted that the drum 18 is supported on very large rollers (not shown) and typically rotates at about 3 rpm. Additionally, various blades and retarders (not shown) may be arranged within the drum interior and pitched to tend to direct tar sand lumps back to the feed and increase the residence time of the lumps in the drum to insure intimate mulling with the feed water and steam which is injected into the sand. (See the previously mentioned Canadian Pat. No. 918,588.)

Figure 3:
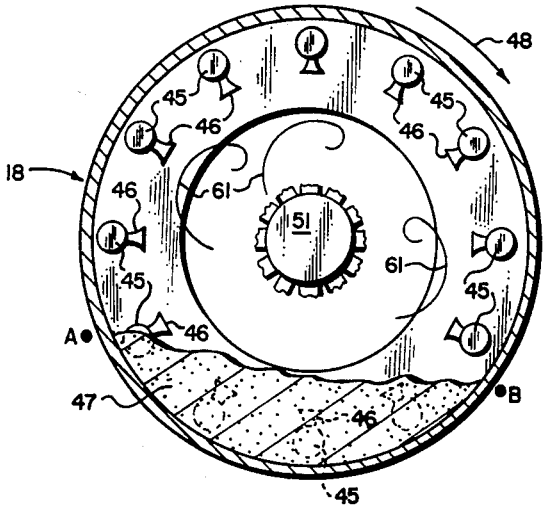
FIG. 3 is a cross-sectional view, taken along the line 3—3 of FIG. 2 and illustrating the manner in which tar sands are mulled and heated therein.

Referring now to FIG. 3, the mechanical effects, and more particularly, thermodynamic effects, of conditioning tar sands within the drum 18 constructed according to the present invention may be appreciated as compared with the corresponding effects associated with tar sands conditioning in the prior art drum. Consider the tar sands pulp 47 being mulled within the drum 18. As the drum rotates in the direction indicated by the arrow 48, the pulp is lifted slightly in the region just below the point "A" and depressed slightly in the region just below the point "B" as a straightforward result of the pipes 45 and other internal drum structure (not shown) passing through the pulp. Thus, point "A" represents the drum just after it emerges from the pulp 47 and point "B" represents the drum just prior to entering into intimate contact with the pulp 47. It is important to note that, unlike the prior art conditioning drums, all the nozzles 46 simultaneously and continuously expel steam, and this steam is concentrated near the entrance position of the cold tar sands. As a result, because of the contact with the pulp and consequent heat transfer from the drum as it passes from point "B" to point "A", the drum will be coldest at point "A". However, as a given point on the drum rotates from point"A" to point "B", it is heated by the steam issuing from those nozzles 46 which are transiently above the surface of the pulp 47. Thus, the drum wall, as well as additional interior drum structure (such as the retarders, blades, pipes, etc.), is at its highest temperature at point "B" and thus in the best condition to impart heat to the pulp 47 by simple convection. In addition, inasmuch as the temperature of the drum wall and inner components are all at higher temperatures than the pulp 47 (except for an insignificant area in the region of point "B"), the pulp 47 is also heated by radiation from the drum interior above the pulp surface. Further, as in the prior art system, heat is imparted to the pulp 47 as a consequence of the steam being sparged below its surface from the several nozzles transiently situated below the surface. It may be noted that sloping walls provide an excellent surface for condensation. This mechanism has the advantage of large surface area and the opportunity to transport the condensed water down into the slurry by drum rotation.

A highly important heat exchange process which occurs in a conditioning drum prepared according to the present invention is the phenomenon of droplet formation in the steam cloud within the drum represented in FIG. 3 by the swirls 61. This mechanism is very similar to the formation of rain droplets in atmospheric clouds and requires only the presence of small solid particles to trigger it. The nozzles transiently disposed beneath the surface of the pulp are directed generally upwardly and therefore impel considerable quantities of sand particles into the steam cloud to serve as surfaces for the formation of droplets. Additionally, as the pipes 45, their support structure, and other internal drum components exit from the pulp 47 in the region of point "A", they carry a quantity of sand to the top of the drum from which they fall downwardly through the steam cloud. These sand particles provide an excellent surface to which the steam can adhere and coalesce to form hot water which is immediately transported to the surface of the pulp by the falling sand particles and is promptly mixed into the pulp mass by the mulling action of the drum.

These heat transfer effects may be distinctly contracted with those obtained by prior art conditioning drums in which steam is only sparged below the surface of the tar sands pulp. With this condition, the drum walls and inner drum constituents will have the highest temperature at point "A" and the lowest temperature at point "B" since the drum is cooled by exposure to the ambient atmosphere. Therefore, heat is tranferred by radiation from the pulp to the drum walls and constituents, and by convection, beneath the surface of the pulp 47, from the pulp to the drum walls and other constituents. Both effects are directly opposite to what is desired and achieved by the subject invention. It will therefore be seen that the present configuration is thermodynamically far superior on both accounts.

Since the theory of the prior art drum called for most (ideally, all) of the heat transfer from the steam to the pulp to take place as a result of sparging the steam directly into the pulp, only a modest, "unavoidable" degree of droplet formation occurred such that only a small fraction of the potential heat transfer capability of this mechanism was fortuitously achieved.

Considering the several heat exchange mechanisms discussed above, it will be understood that, in effect, a highly "complex multi-surface heat exchanger" is obtained. The extent of the thermodynamic superiority of the present conditioning drum over the prior art may be judged from a consideration that, with the present drum, approximately 75% of the condensation is due to the wet, multi-surface "condensor" (water droplet formation in the steam cloud, the inner surfaces of the drum and the other heat transfer surfaces within the drum such as the pipes, retarders, etc.); about 15% is due to the steam to drum's shell heat transfer and steam condensation on the inner shell and other constituents; and only about 10% of the condensation is due to sparging the steam beneath the surface of the pulp and radiation heat transfer. In the prior art drums, this sparging effect accounts for virtually the whole of the heat transfer from the steam to the pulp (in conjunction with heat transfer from the hot pipes and fortuitous minor droplet formation).

As a more specific example, it was previously difficult to introduce 100,000 pounds of steam per hour into a prior art conditioning drum at the Suncor facility whereas 180,000 pounds per hour is now routinely achieved with the present drum.

Referring simultaneously to both FIG. 2 and FIG. 3, the mechanical superiority of the present invention over the prior art drum will also be readilly apparent when it is observed that the steam distribution fitting 44 need only be an appropriately dimensioned rotating joint as described above rather than a sparge valve, and there need be only a few relatively large (e.g., 2.75 inch d) nozzles 46 (typically twelve) rather than on the order of 1200 smaller nozzles as required in the prior art conditioning drum. Thus, the capital costs of the components are far lower as are the labor costs of changing out the wearable elements. Further, much longer service is experienced with the present conditioning drum because the nozzles are always pressurized and hence are not susceptible to ingesting sand, rocks, and the like which cause serious wear problems with the sparge valves and nozzles of the prior art conditioning drums.

While the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

The embodiments of the present invention in which an exclusive property or privilege is claimed are defined as follows:

1. A tar sand conditioning vessel comprising:

(a) a cylindrical drum rotatable around its longitudinal axis, said drum having at least one opening at each end thereof such that mined tar sands to be conditioned can be introduced into one end of said drum, mixed with steam and water, and discharged from the opposite end thereof;

(b) a steam distribution fitting axially disposed proximate one end of said drum, said fitting including a stationary portion connected to a source of steam and a rotatable portion having a plurality of radially distributed outlet ports, said stationary and rotatable fitting portions being coupled to provide a continuous supply of steam to each of said outlet ports regardless of the angular position thereof; and (c) a steam distribution network including:

(i) a plurality of steam conduits generally longitudinally arrayed around the inner periphery of said drum, a first end of each of said conduits being connected to one of said fitting outlet ports, second ends of said conduits all being closed off; and (ii) at least one radially inwardly directed steam discharge nozzle being affixed to each of said conduits proximate the closed end thereof;

whereby steam is continuously discharged from all said nozzles to correspondingly continuously generate a dense steam cloud in the drum interior and heat the inner wall and components of said drum as it rotates in order to transfer heat to the tar sand pulp being conditioned (1) by radiation, (2) by convection, (3) by droplet formation, and (4) by sparging the steam beneath the pulp surface.

* * * * *